US008074842B2

(12) United States Patent
Edwards et al.

(10) Patent No.: US 8,074,842 B2
(45) Date of Patent: Dec. 13, 2011

(54) METHOD AND APPARATUS FOR A MODULAR DISPENSING TOWER

(75) Inventors: William A. Edwards, Selma, TX (US); Gary V. Paisley, Alpharetta, GA (US); Douglas J. McDougall, Marietta, GA (US); Daniel S. Quartarone, Stone Mountain, GA (US); Samuel L. Orr, Jr., Hoschton, GA (US)

(73) Assignees: Lancer Partnership, Ltd., San Antonio, TX (US); The Coca-Cola Company, Atlanta, GA (US)

( * ) Notice: Subject to any disclaimer, the term of this patent is extended or adjusted under 35 U.S.C. 154(b) by 764 days.

(21) Appl. No.: 11/801,125

(22) Filed: May 8, 2007

(65) Prior Publication Data

US 2008/0277420 A1 Nov. 13, 2008

(51) Int. Cl.
*B67D 5/56* (2006.01)

(52) U.S. Cl. ..... 222/129.1; 222/146.6

(58) Field of Classification Search .... 222/129.1–129.4, 222/146.1, 146.6, 108; 62/390
See application file for complete search history.

(56) References Cited

U.S. PATENT DOCUMENTS

| | | | | |
|---|---|---|---|---|
| 3,580,425 | A * | 5/1971 | DeMan | 222/129.1 |
| 4,592,490 | A * | 6/1986 | McMichael | 222/129.1 |
| 4,860,923 | A * | 8/1989 | Kirschner et al. | 222/1 |
| 5,433,348 | A | 7/1995 | Deering et al. | 222/129.1 |
| 5,437,395 | A | 8/1995 | Bull et al. | |
| 5,992,685 | A * | 11/1999 | Credle, Jr. | 222/1 |
| 6,439,428 | B1 * | 8/2002 | Schroeder et al. | 222/64 |
| 6,547,100 | B2 * | 4/2003 | Phillips et al. | 222/129.1 |
| 6,698,229 | B2 * | 3/2004 | Renken et al. | 62/390 |
| 6,698,621 | B2 * | 3/2004 | Landers et al. | 222/129.1 |
| 7,287,671 | B2 * | 10/2007 | Morrow et al. | 222/129.1 |
| 7,624,895 | B2 * | 12/2009 | Haskayne | 222/129.1 |
| 7,641,074 | B2 * | 1/2010 | Edwards et al. | 222/130 |
| 2002/0084284 | A1 * | 7/2002 | Landers et al. | 222/129.1 |
| 2003/0168472 | A1 * | 9/2003 | Segiet | 222/129.1 |
| 2005/0230421 | A1 | 10/2005 | Morrow, Sr. et al. | |
| 2006/0027598 | A1 * | 2/2006 | Ubidia et al. | 222/129.1 |
| 2006/0071015 | A1 * | 4/2006 | Jablonski et al. | 222/1 |
| 2007/0056988 | A1 * | 3/2007 | Edwards et al. | 222/129.1 |
| 2008/0129159 | A1 * | 6/2008 | Johnson et al. | 312/111 |

FOREIGN PATENT DOCUMENTS

| | | | |
|---|---|---|---|
| DE | 3904457 | | 8/1990 |
| DE | 3904457 | A1 | 8/1990 |
| DE | 29824320 | | 3/2001 |
| DE | 29824320 | U1 | 3/2001 |
| EP | 0895959 | A2 | 2/1999 |
| EP | 1172329 | A | 1/2001 |
| EP | 1172329 | | 1/2002 |
| WO | WO 02/094705 | A1 | 11/2002 |

* cited by examiner

*Primary Examiner* — Kevin P Shaver
*Assistant Examiner* — Donnell Long
(74) *Attorney, Agent, or Firm* — Christopher L. Makay

(57) ABSTRACT

A dispenser including a plurality of tower sections allows an operator to remove one or more tower sections from the fluid dispenser without removing the fluid dispenser from a dispensing location. A housing of the dispenser includes multiple arrays of outlets from a housing fluid circuit that is connectable to fluid sources. Separate tower sections including complementary arrays are then coupled to arrays of the housing, thereby extending the housing fluid circuits to the dispense points disposed on the tower sections. The tower sections are secured to the fluid dispenser housing. The tower sections may further include mounting members that mate together to provide additional restraint and to ensure that the dispense points of the attached tower sections are aligned, thereby providing a clean, uniform appearance.

26 Claims, 9 Drawing Sheets

METHOD AND APPARATUS FOR A MODULAR DISPENSING TOWER

BACKGROUND OF THE INVENTION

1. Field of the Invention

The present invention relates to fluid dispensing equipment and, more particularly, but not by way of limitation, to methods and an apparatus for providing modular components in a beverage dispensing tower.

2. Description of the Related Art

Product dispensers in the beverage dispensing industry typically are hard plumbed, and have a life expectancy of approximately seven years. However, the product side of the product dispensing market changes rapidly, as food product manufacturers continuously create products aimed to capture a particular group of customers. Illustratively, beverage dispensing trends have moved from predominantly carbonated beverages to non-carbonated beverages, including waters, flavored waters, teas, juices, and the like. As such, retail account owners often find themselves with a product dispenser that is incapable of delivering newly popular products.

Problems arise when retail account owners desire to change their product availability. If the product dispenser is minimally upgradeable, it may not accommodate the newly desired product list. Some products may require particular hardware on the tower, but a single tower dispenser does not provide the flexibility to remove and replace a portion of the tower. The problems are compounded when the beverage dispenser must be removed from a dispensing location to be retrofit, thereby forcing the establishment to lose sales and customers while the product dispenser is being retrofit.

Accordingly, a product dispenser that is reconfigurable in the field would be beneficial to product dispenser owners, product consumers, as well as product dispenser manufacturers.

SUMMARY OF THE INVENTION

In accordance with the present invention, a dispenser includes a plurality of towers (the term "tower" means a modular component that can take the shape of a tower or any other shape). Each of the towers may be connected to one or more dispense points and deliver fluids to these dispense points.

In a first embodiment, a first tower is coupled to a first array, thereby extending a first fluid circuit to the dispense points disposed on the first tower, and a second tower is coupled to a second array, thereby extending a second fluid circuit to any dispense points disposed on the second tower. It should be understood that the fluid circuits may be above, behind, to the side, or in any other physical relationship to the towers. A third tower may also be coupled to a third array, thereby extending a third fluid circuit to any dispense points disposed on the third tower. The towers may be secured to a dispenser housing (or may be molded as one unit with the dispenser and its housing), and may further be secured to each other to provide restraint and to ensure that the dispense points of the varying towers are aligned.

In a second embodiment, the third tower is replaced with a mounting member disposed between the first and second towers. The mounting member includes dispense points attached thereto. The second embodiment further includes flexible tubing disposed between a third array of the product dispenser and the dispense points, thereby providing the ability to reconfigure product delivered to the dispense points disposed in the mounting member.

It is therefore an object of the present invention to provide a dispenser having a plurality of towers, wherein a fluid is dispensed from dispense points disposed on the towers.

It is a further object of the present invention to provide removable towers on the dispenser, wherein the towers are removable and replaceable in the field.

It is still further an object of the present invention to provide a dispenser with a plurality of arrays disposed on a top plate.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Figure 1:
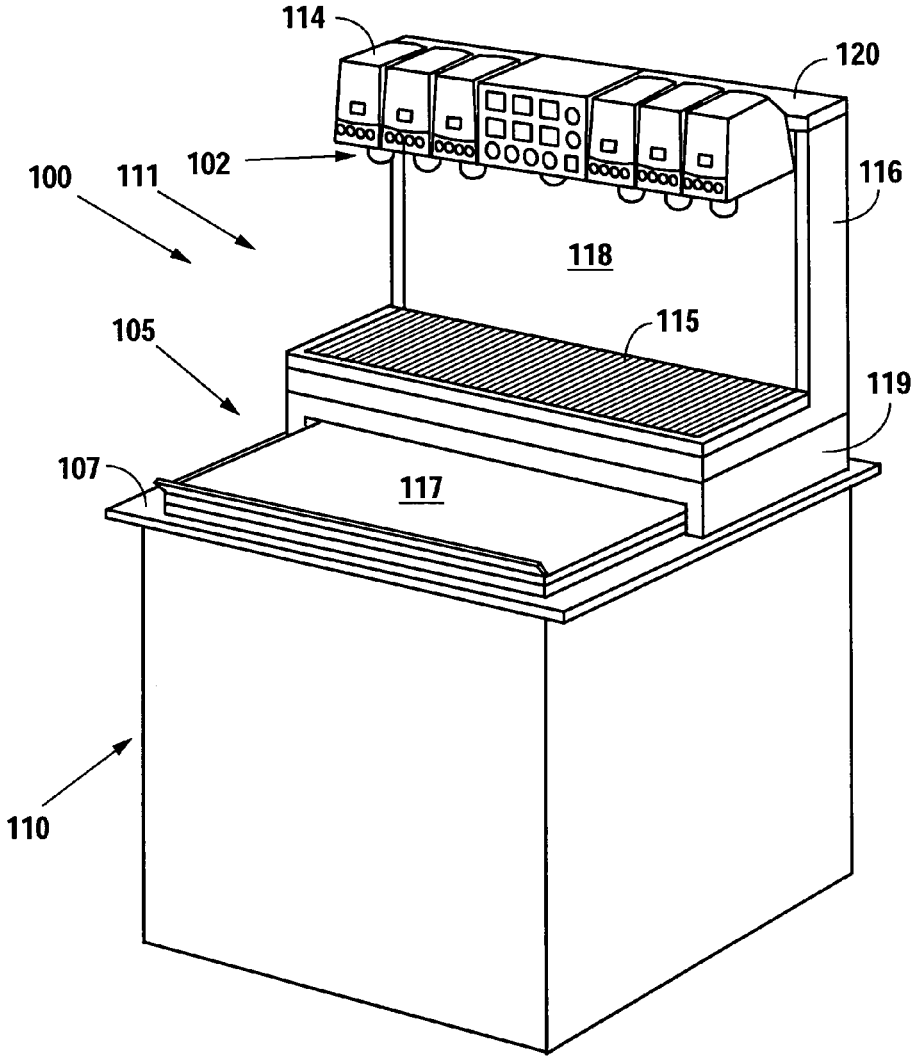
FIG. 1 provides a perspective view of a dispenser according to the first embodiment.
Figure 2A:
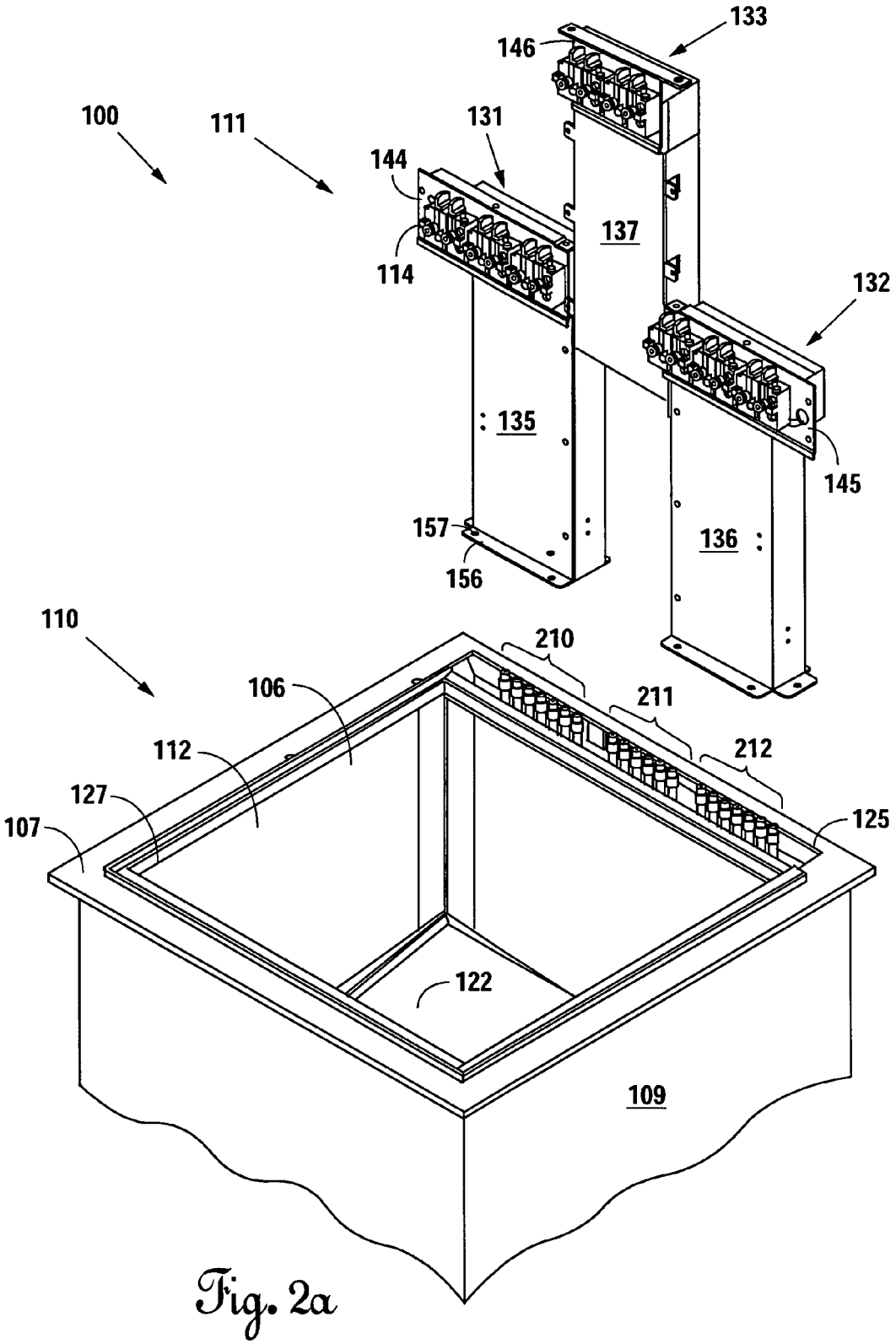
FIG. 2*a* provides an exploded view of a dispenser including multiple tower sections according to the first embodiment.
Figure 2B:
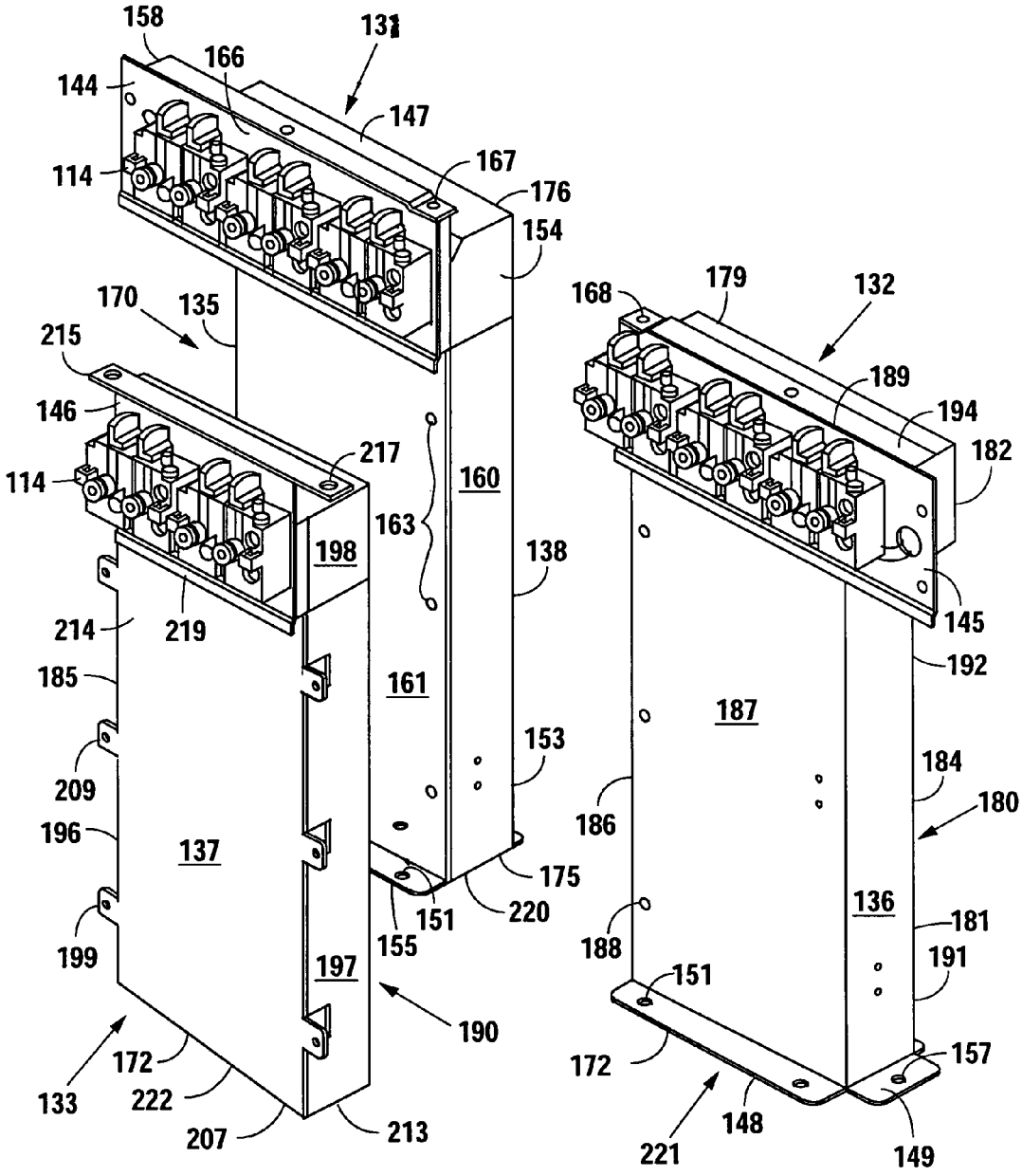
FIG. 2*b* provides a detail view of the towers according to the first embodiment.

As shown in FIGS. 1-2*b*, a product dispenser 100 is any device suitable to deliver a chilled product alone, an ambient product alone, a heated product alone, a chilled product concentrate for mixing with a chilled diluent or an ambient or heated diluent, or an ambient or heated product concentrate for mixing with a chilled diluent or an ambient or heated diluent. Illustrative products are fluids including but not limited to carbonated beverages, teas, waters, juices, and the like. The product dispenser 100 includes a tower unit 111 disposed on a housing 110, whereby the tower unit 111 supports at least one dispense point 102 for delivering a product alone or for mixing concentrates with a diluent to deliver a reconstituted product. A dispense point 102, in the preferred embodiments, is any form of flow regulation device that may be utilized to deliver a product into an operator's receptacle. For example, a product valve 114, a fluid tap, a spigot, or the like may be utilized as a dispense point 102. The tower unit 111 includes tower sections 131-133, whereby the tower sections 131-133 permit reconfiguration of the product dispenser 100 without removing the product dispenser 100 from a dispensing location. While the tower unit 111 has been disclosed with tower sections 131-133, those of ordinary skill in the art will recognize that there may be only two tower sections, as well as more than three. Furthermore, the housing 110 is any type housing, frame, or support known in the art of product dispensing suitable for the support of components for a refrigerated dispenser, an ice cooled dispenser, an ambient or hot product dispenser, and the like. Moreover, while the tower unit 111 has been disclosed as disposed on the housing 110, those of ordinary skill in the art will recognize other suitable locations, such as next to the housing 110, underneath the housing 110, or within the housing 110.

The tower section 131 is fitted with three dispense points 102, wherein the dispense points 102 are product valves 114. While the tower section is disclosed with three valves 114, one of ordinary skill in the art will recognize that only one is required and that any number of product valves may be utilized. The tower section 131 includes a first tower casing 135, a first tower cap 147, a first mounting member 144, and a first tower product circuit 170. In this first embodiment, the first tower casing 135 is of a hollow rectangular construction, and includes a first end 153 and a second end 154. The first tower product circuit 170 passes through the first tower casing 135 from the first end 153 to the second end 154 en route to the first mounting member 144, which may be a faucet plate. The first tower casing 135 may be constructed from any material suitable to provide structural support to components disposed directly, or indirectly, on the first tower 131, including multiple product valves 114, the first mounting member 144, and the like. Illustratively, in this example, the first tower casing 135 includes a body 138 having a hollow rectangular cross section, a first inter-tower face 160, and a working face 161. The first tower cap 147 is a rectangular shaped box that is of a size complementary to at least one dimension of the cross section of the first tower casing 135, such that the first tower cap 147 fits onto the first tower casing 135 and closes out the second end 154 of the first tower casing 135. The first tower cap 147 further includes an aperture 158 that provides passage of the product lines from the first tower product circuit 170 from the interior of the body 138 to the first mounting member 144.

The first end 153 of the first tower casing 135 includes a mounting flange 155 extending from the working face 161, and a mounting flange 156 extending from the side of the body 138 opposite the first inter-tower face 160. The mounting flange 155 is disposed substantially perpendicular to the first tower casing 135, and includes at least one mounting aperture 151. The mounting flange 156 is similarly disposed substantially perpendicular to the first tower casing 135, and includes at least one mounting aperture 157. The working face 161 includes apertures 163 that are disposed in proximity to the first inter-tower face 160.

The first mounting member 144 is planar in shape and extends from the first inter-tower face 160 and along the working face 161 of the first tower casing 135. The first mounting member 144 may be shortened or lengthened to accommodate a desired number of dispense points 102. The first mounting member 144 further includes tubing apertures 166 that allow the product lines of the first tower product circuit 170 disposed within the first tower 131 to be aligned at a spacing consistent with a spacing of product valves 114, such that product valves 114 may be successfully attached and removed from the first mounting member 144. The first mounting member 144 further includes an attachment point 167 disposed substantially perpendicular to the face housing the dispense points 102.

The first tower product circuit 170 includes product lines disposed within the tower section 131, and further includes a first end 175 and a second end 176. In this specific example, the first tower product circuit 170 includes tower product lines 300-306 in order to support the dispense points 102. The first ends 175 are disposed in an arrangement complementary to a mating array of the housing 110. In this example, the first ends 175 are disposed in a first tower array 220 that is complementary to a first array 210 of the housing 110, and the second ends 176 extend through the tubing apertures 166 of the first mounting member 144 for connection to the dispense points 102. While the invention has been disclosed with multiple product lines disposed within the tower section 131, one of ordinary skill in the art will recognize that a single product line may be utilized to support a single dispense points 102 in delivering a single product, or two product lines may be utilized to support a dispense points 102 in delivering a reconstituted product. The first tower product circuit 170 may be constructed from virtually any lines suitable for use with product dispensing systems. Illustratively, in this first embodiment, the first tower product circuit 170 is constructed from stainless steel, and include suitable connections for adapting to the product lines of the housing 110, such as the example disclosed in U.S. Pat. No. 5,433,348. Suitable connections are also provided for adapting to the product valves 114 disposed on the first tower 131. In this example, the connections to the product valve 114 are dole fittings. The first tower 131 still further includes an insulation disposed within the first tower 131, such that the product lines of the first tower product circuit 170 are fixed at a proper spacing. In this first embodiment, the insulation 172 is a foam-in-place insulation that must be blown and cured.

On assembly, the tower cap 147 is attached to the second end 154 of the tower casing 135. The mounting member 144 is then attached to the tower cap 147 utilizing any suitable means, including mechanical fasteners, welding, or the like. Next, the second ends 176 of the product lines of the first tower product circuit 170 are placed into the tower casing 135, such that the second ends 176 protrude from the apertures 158 of the mounting member 144. The first ends 175 are then fixtured in the first tower array 220, such that they are in proper alignment with the first array 210 of the housing 110. Once the first and second ends 175 and 176 are properly aligned, the tower may be filled with insulation, thereby permanently disposing the product lines in correct alignment. Further assembly entails the product valves 114 being attached to the first mounting member 144.

The tower section 132 is substantially symmetrical to the tower section 131, and includes a tower casing 136, a tower cap 179, a mounting member 145, and a second tower product circuit 180. The tower casing 136 is similar in construction and form to the tower casing 135, and includes a body 184 having a rectangular cross section. The body 184 includes a second working face 187, and a second inter-tower face 186. The tower cap 179 is symmetrical to the tower cap 147 and is complementary to at least one dimension of the cross section of the tower casing 136, such that the tower cap 179 fits onto the tower casing 136 and closes out the second end 192 of the tower casing 136. The tower cap 179 further includes an aperture 189 that provides passage of the product lines of the second tower product circuit 180 from the interior of the body 184 to the mounting member 145, which may be a faucet plate.

The first end 191 includes a mounting flange 148 extending from the second working face 187, and a mounting flange 149 extending from the side of the body 184 opposite the second inter-tower face 186. The mounting flange 148 is disposed substantially perpendicular to the tower casing 136, and includes at least one mounting aperture 151. The mounting flange 149 is similarly disposed substantially perpendicular to the tower casing 136, and includes at least one mounting aperture 157. The second working face 187 includes apertures 188 that are disposed in proximity to the second inter-tower face 186.

The mounting member 144 is planar in shape and extends from the second inter-tower face 186 and along the working face 187 of the tower casing 136. The mounting member 145 may be shortened or lengthened to accommodate a certain number of dispense points 102. The mounting member 145 further includes tubing apertures 194 that allow the product lines of the second tower product circuit 180 disposed within the tower section 132 to be aligned at a spacing consistent with a spacing of product valves 114, such that product valves 114 may be successfully attached and removed from the mounting member 145. The mounting member 145 further includes a second attachment point 168 disposed substantially perpendicular to the face housing the product valves 114.

The second tower product circuit 180 includes product lines disposed within the tower section 132, and further includes a first end 181 and a second end 182. In this example, the second tower product circuit 180 includes tower product lines 307-313. The first ends 181 are disposed in a second tower array 221 that is complementary to a second array 211 of the housing 110, and the second ends 182 extend through the apertures 194 of the mounting member 144 for connection to the dispense points 102. The product lines of the second tower product circuit 180 may be constructed from virtually any line suitable for use with product dispensing systems. Illustratively, in this first embodiment, the product lines of the second tower product circuit 180 are constructed from stainless steel, and include suitable connections for adapting to the product lines of the housing 110, as well as the dispense points 102 disposed on the tower section 132. The tower section 132 still further includes an insulation 172 disposed within the tower casing 136, such that the product lines of the second tower product circuit 180 are secured in a proper location. In this first embodiment, the insulation 172 is a foam-in-place insulation that must be blown in place and cured.

Assembly of the tower section 132 is substantially identical to that of the tower section 131, and, therefore, will not be described.

The tower section 133 is fitted with two dispense points 102. In this example, the two dispense points 102 are product valves 114. While this tower section 133 has been disclosed with two product valves 114, one of ordinary skill in the art will recognize that any number of product valves 114 may be utilized. The tower section 133 includes a tower casing 137, a tower cap 147, a mounting member 146, and a third tower product circuit 190. The tower casing 137 is constructed similarly to the tower casings 135 and 136, and includes a first end 207 and a second end 208. The tower casing 137 further includes a body 185 having a hollow rectangular cross-section. The tower casing 137 includes a third inter-tower face 196, a fourth inter-tower face 197, and securing flanges 199 extending from the third and fourth inter-tower faces 196 and 197. The securing flanges 199 are disposed in an arrangement complementary to the apertures 163 and 188 of the tower sections 131 and 132, and include apertures 209 for accepting fasteners.

In similar fashion to the tower sections 131 and 132, the second end 208 of the tower casing 137 is closed out with a tower cap 198 having an tubing aperture 215, such that the product lines of the third tower product circuit 190 may extend through the tubing aperture 215 to access the mounting member 146, which may be a faucet plate. The mounting member 146 is of a similar construction to the mounting members 144 and 145, however, the mounting member 146 is shorter, and includes clearance apertures 217 disposed in a top face. Upon installation, the clearance apertures 217 are located complementary to the apertures 167 and 168 of the mounting members 144 and 145. The mounting member 145 further includes tubing apertures 219 for accepting the product lines of the third tower product circuit 190.

The third tower product circuit 190 includes the product lines disposed within the tower section 133, and further includes first ends 213 and second ends 214. In this example, the third tower product circuit 190 includes a tower product lines 314-319. The first ends 213 of the product lines of the third tower product circuit 190 are disposed in a third tower array 222 that is complementary to a third array 212. The product lines of the third tower product circuit 190 pass through the tower section 133 such that the second ends 214 pass through the tubing apertures 219 of the mounting member 146, and are restrained in position, thereby providing connection points for the dispense points 102. One of ordinary skill in the art will recognize that the use of mounting members is commonplace in the beverage dispensing industry, however, the use of a multiple segment mounting member in not commonplace.

Assembly of the tower section 133 is substantially identical to the tower sections 131 and 132, and therefore, will not further be described.

As shown in FIGS. **2*a*-3*a*, the housing 110 in this first embodiment includes a bin 106 for the storage of ice. The bin 106 includes four lateral walls that extend from a cold plate 122 to a top plate 107, thereby forming a chamber 112. The bin 106 may be of any suitable construction, such that it does not contaminate product disposed within the chamber 112. In this first embodiment, the bin 106 is constructed from a stainless steel, and is spot-welded to the top plate 107. The cold plate 122 serves as a floor of the bin 106, such that ice may be stored within the bin 106. The top plate 107 is substantially planar, and extends beyond the footprint of the bin 106, such that an extending lip supports the housing 105 when the product dispenser 100 is installed into the counter. The housing 105 further includes an insulated wrapper 109 that surrounds and protects the components of the housing 110, and increases the thermal efficiency of the product dispenser 100**.

The cold plate 122 is of the type commonly utilized in the beverage dispensing industry, and includes product lines that enter a front area of the cold plate 122, make multiple passes through the cold plate 122, and then exit the cold plate 122 through a rear face. The product lines then extend upward to reach the tower unit 111 of the product dispenser 100. The product lines further include quick-disconnect fittings, such as those disclosed in U.S. Pat. No. 5,433,348, thereby providing an easily removable connection point between the housing 110 and the tower sections 131-133. An upper surface of the cold plate 122 is disposed within the bin 106, such that ice is stored on top of the cold plate 122, thereby removing heat from the cold plate 122 and the product lines passing through the cold plate 122.

The top plate 107 further includes a bin aperture 127 disposed above the bin 106 and a tubing aperture 125 that allows the passage of the product and diluent lines from the housing 110 to the tower unit 111. The bin aperture 127 provides access to the bin 106, and includes a raised edge 128 to aid in locating a lid 117 and a drip tray 119. The tubing aperture 125 is disposed behind the bin aperture 127, such that product and diluent lines exiting the cold plate 122 bend upward to the tubing aperture 125, and terminate slightly beyond an upper surface of the top plate 107. One of ordinary skill in the art will recognize that the product and diluent lines and connectors may be of any form of construction suitable for use in the beverage dispensing industry. In this example, the product and diluent lines are disposed within the cold plate 122, and are formed from stainless steel, and include connections suitable for mating to remote concentrate or diluent sources.

Figure 3A:
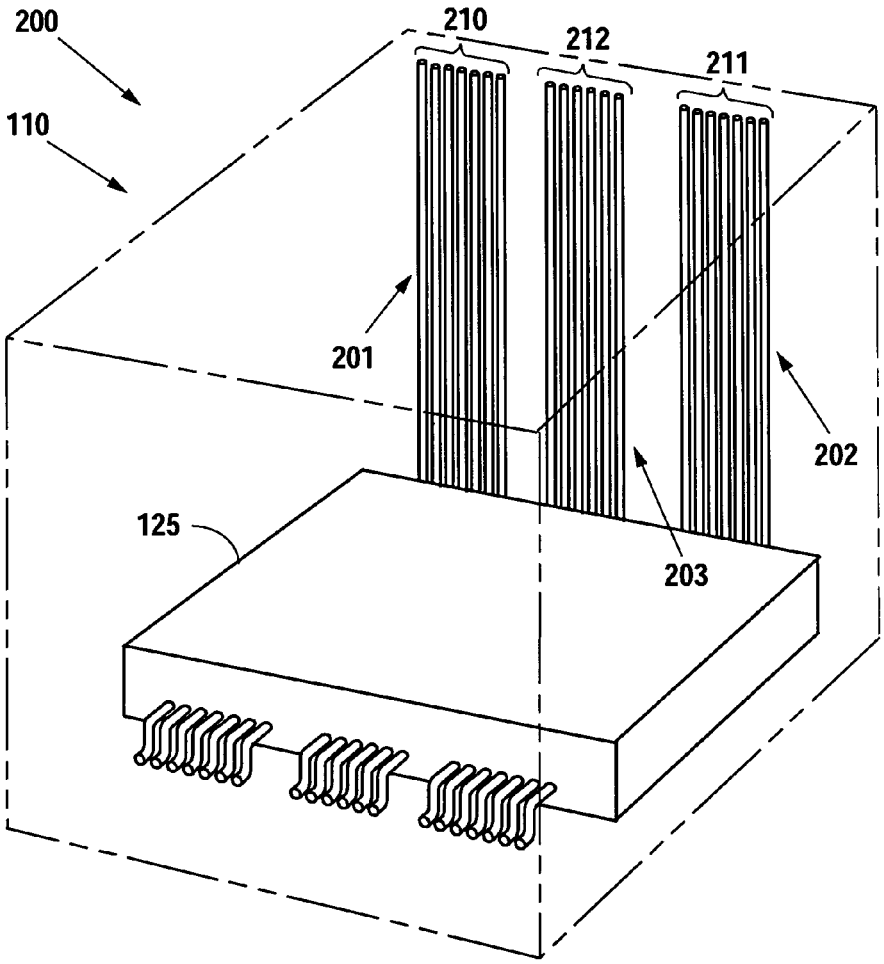
FIG. 3*a* provides a perspective view illustrating a housing product circuit according to the first embodiment.
Figure 3B:
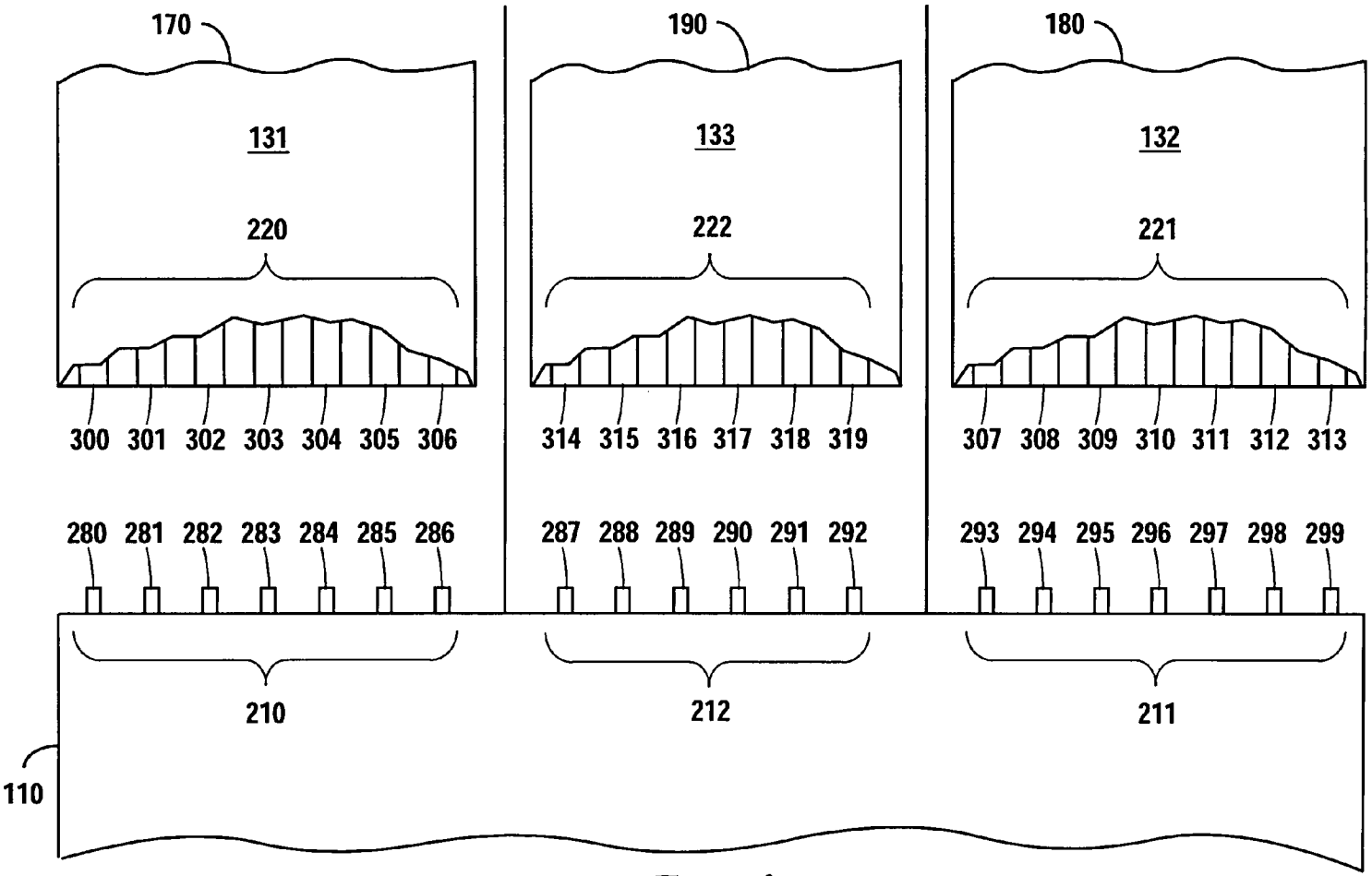
FIG. 3*b* provides a detail view of the interfacing product lines according to the first embodiment.

As shown in FIGS. 3*a*-3*b*, the housing 110 includes a housing product circuit 200, wherein portions of the product lines are disposed within the cold plate 122 for cooling. The housing product circuit 200 includes housing product lines 280-299. The outlets of the product lines 280-299 are disposed in single file arrangement, and at a predetermined spacing along the tubing aperture 125. While the outlet group has been shown as a single array having outlets disposed in a single file arrangement, one of ordinary skill in the art will recognize that the groups may be formed virtually any shape, including lines, arrays, circles, and the like. Accordingly, the single array may be broken into multiple groups that form separate arrays to complement a split tower design. As shown in FIG. 3*a*, the housing product circuit 200 is separated into subgroups that are complementary to the tower sections 131-133. Illustratively, the housing product circuit 200 is divided into a first housing product circuit 201 including ends terminating in a first array 210, a second housing product circuit 202 terminating in a second array 211, and a third housing product circuit 203 terminating in a third array 212.

As shown in FIG. 3*a*, the first housing product circuit 201 includes the housing product lines 280-286; the second housing product circuit 202 includes the housing product lines 293-299; and the third housing product circuit 203 includes housing product lines 287-292. In this particular example, the first array 210 includes three concentrate lines, three carbonated diluent lines, and one plain diluent line, the second array 211 is identical to the first array 210, and the third array 212 includes two concentrate lines, two carbonated diluent lines, and two plain diluent lines. While this invention has been shown with a full complement of products in each tower, one of ordinary skill in the art will recognize that it is possible for the arrays 210 through 212 to include only one product line, thereby delivering only one product.

The product dispenser 100 further includes a shell 116, a cap 120, and a splash plate 118 for protecting and supporting the tower sections 131, 132, and 133. The shell 116 covers a back and the sides of the towers 131, 132, and 133 in an installed position, and the cap 120 is disposed at an upper end of the shell 116. The splash plate 118 closes out an area between the product valves 114 and a drip tray 119. The shell 116, the cap 120, and the splash plate 118 may be constructed from virtually any material that meets structural and cleanability standards. Illustratively, in this example, the shell 116, the cap 120, and the splash plate 118 are constructed from stainless steel.

On assembly, the cold plate 122 is disposed within the housing 105, and the bin walls are secured to the cold plate 122, thereby forming the chamber 112. The top plate 107 and the wrapper 109 are then placed over the cold plate 122 and the bin walls. The product lines extending from the cold plate 122 now extend through the tubing aperture 125 of the top plate 107, and are positioned in correct placement to form at least two arrays. In this specific example, the first array 210, the second array 211, and the third array 212 are formed. The void between the wrapper 109 and the bin walls is then filled with insulation, thereby insulating the chamber 112, and securing the product tubes that extend from the cold plate 122 in place.

The buildup continues with the application of the tower section 131 to the product dispenser 100. The product tubes of first tower product circuit 170 are disposed in the first tower array 220 that is complementary to the first array 210, and the first ends 175 of the product tubes are likewise compatible to the outlets of the first array 210, and therefore, may be coupled to the product lines of the first housing product circuit 201. Upon the installation of the tower section 131, the housing product line 280-286 are coupled to the tower product lines 300-306, respectively, thereby extending the flow circuits to the mounting member 144 and any product valve 114 mounted thereon. The tower section 131 is placed over a portion of the first array 210, and the first ends of the first tower product circuit 170 are placed over the connection points of the first array 210. In this specific example, the first array 210 includes male fittings having o-rings, and a female fitting for each connecting tube disposed on the tower section 131. Upon full insertion, fasteners are placed through the apertures 151 and 157, thereby securing the tower section 131 to the top plate 107. Accordingly, the first tower 131 will not move upwards due to line pressures. While this invention has been shown with mechanical fasteners for securing the tower sections 131, 132, and 133 to the top plate 107, one of ordinary skill in the art will recognize that alternative methods may be utilized.

Next, the tower section 132 is placed onto the second array 211 of the product dispenser 100. As previously disclosed, the product tubes of the second tower product circuit 180 are arranged within the tower section 132, in a second tower array 221 that is complementary to the second array 211, and are connected in similar fashion to the tower section 131. Specifically, housing product lines 293-299 are coupled to tower product lines 307-313. Accordingly, the tower section 232 may deliver plain diluent, carbonated diluent, or concentrate mixed with either one of the diluents, dependent upon the order of the product lines within the tower. In this specific example, the tower section 132 supports three dispense points 102. The tower section 132 is placed over the tubing aperture 125 of the top plate 107, and fasteners are placed through the apertures 151 and 157, thereby securing the tower section 132 to the top plate 107.

The tower section 133 is then installed between the tower sections 131 and 132, such that the third inter-tower face 196 is disposed adjacent to the first inter-tower face 160, and the fourth inter-tower face 197 is disposed adjacent to the second inter-tower face 186. Upon alignment, the third tower array 222 of the third tower product circuit 190 is aligned with the third array 212. Upon full engagement, the outlets of the third array 212 are coupled to the product tubes of the third tower product circuit 190 in the tower section 133 in similar fashion to the tower sections 131 and 132, thereby extending the flow circuits of the third housing product circuit 203 to the mounting member 146 and the product valves 114 disposed thereon. Specifically, housing product lines 287-292 are coupled to tower product lines 314-319. The apertures 209 of the securing flanges 199 are then aligned with the apertures 163 and 188 of the tower sections 131 and 132, and fasteners are then inserted into the apertures 163 and 188, thereby securing the tower section 133 to the tower sections 131 and 132. Additionally, the clearance apertures 217 in the mounting member 146 are aligned with the apertures 167 and 168 in the mounting members 144 and 145, and fasteners are inserted into the apertures 217, 167, and 168, thereby securing the mounting member 146 to the mounting members 144 and 145. At this point, the tower sections 131, 132 and 133 are interconnected, and the product valves 114 are disposed in alignment, thereby providing a clean, streamlined appearance.

The build up continues with the installation of the shell 116 around the back and sides of the tower sections 131, 132, and 133. The shell 116 is formed to encapsulate the tower sections 131, 132, and 133, and may be secured to the top plate 107. The cap 120 is then installed onto an upper end of the shell 116, thereby closing out the upper portion of the shell 116. The drip tray 119 may then be installed onto the top plate 107, and the splash plate 118 is then installed between the product valves 114 and the drip tray 119.

Figure 4A:
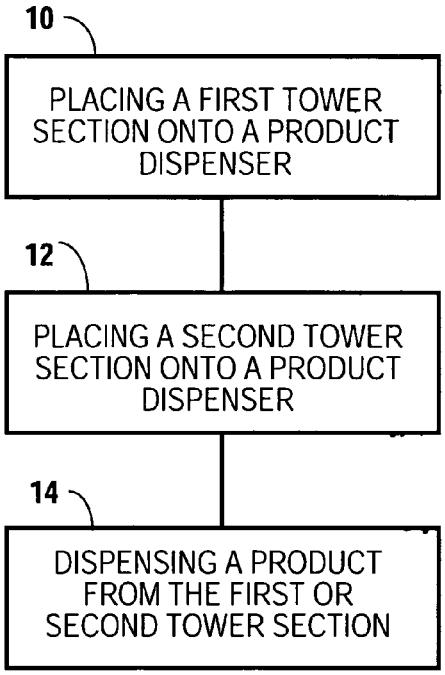
FIG. 4*a* provides a flowchart illustrating the method steps for installing multiple towers according to the first embodiment.

As shown in the method flowchart of FIG. 4*a*, an operator may install a tower section 131 onto a product dispenser housing 105, step 10, thereby extending a first housing product circuit 201 through to any product valves disposed on the tower section 131. The operator then installs a tower section 132 onto the product dispenser housing 105, thereby extending a second housing product circuit 202 through to any product valves 114 disposed on the tower section 132, step 12. Next, the operator may dispense a product from either of the tower sections 131 or 132, step 14. As previously disclosed, the housing product circuits 201-203 are capable of delivering all types of products, including concentrates, carbonated diluents, and plain diluents.

Figure 4B:
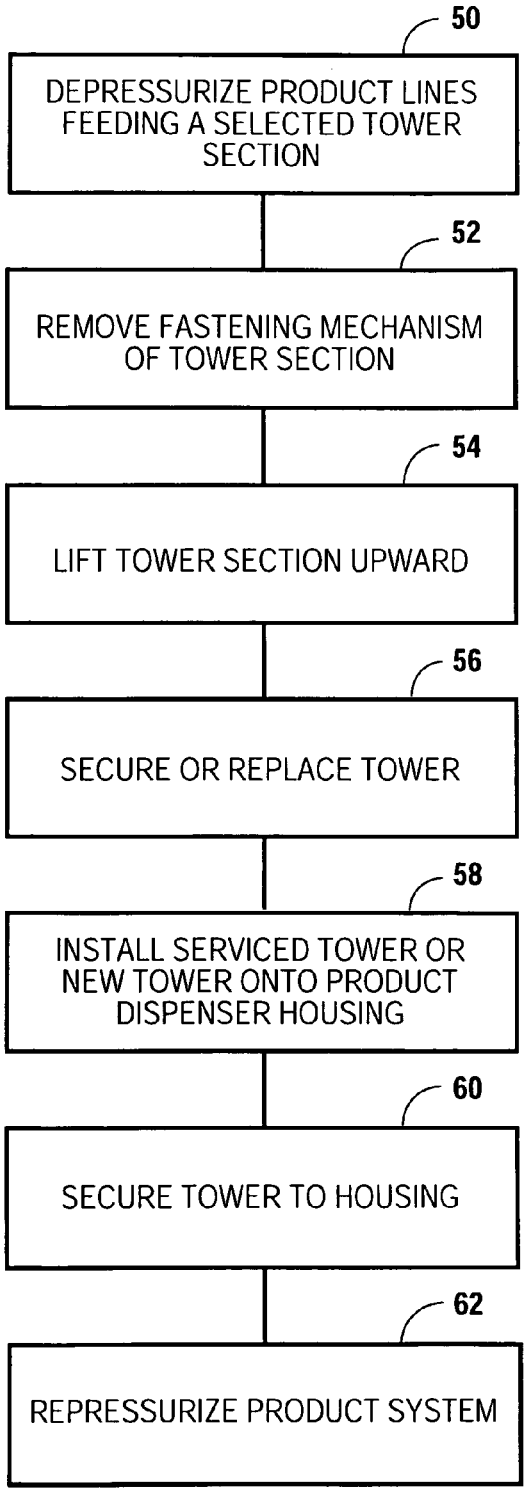
FIG. 4*b* provides a flowchart illustrating the method steps for replacing at least one tower on a product dispenser according to the first embodiment.

The operator further has the ability to reconfigure the product dispenser 100 by replacing or removing any number of tower sections 131, 132, or 133. FIG. 4*b* illustrates the method steps for replacing a tower section on the product dispenser 100 without removing the product dispenser 100 from a dispensing location. The process starts with step 50, wherein the operator depressurizes the product lines feeding a tower section to be replaced. Step 52 provides for removing the fasteners securing the tower section being removed to adjacent tower sections and a top plate 107 of the product dispenser 100. The operator may then lift the tower section to be removed upward to separate the tower section from the outlets of the connected array, step 54. Step 56 provides for servicing or replacing the tower section that has been removed. The operator then installs the serviced tower section or new tower section onto the complementary array, step 58. In step 60, the operator must secure the tower section to adjacent tower sections or the top plate 107. Once the system is secured, the operator may repressurize the product system, step 62.

It should be clear to one ordinary skill in the art that tower sections may be replaced with tower sections having a different number of dispense points 102. Illustratively, product lines disposed within a tower section may be diverted to more than one dispense point 102. Alternatively, tower sections having fewer product lines may be placed onto the arrays, thereby reducing the number of dispense points 102. Accordingly, a tower section including three dispense points may be substituted with a tower section having more or fewer dispense points, provided the complementary product supply changes have been accomplished. Further, the types of dispense points 102 utilized in this invention may also be substituted. Illustratively, a tower section having a product valve 114 may be replaced with a fluid tap, if desired, as long as the fluid is compatible with the newly installed dispense point 102.

While this invention has been shown with three tower sections 131, 132, and 133, one of ordinary skill in the art will recognize that only two tower sections are required, and that four or more is possible. The invention provides the flexibility to remove any number of tower sections, or to substitute any or all of the tower sections. One of ordinary skill in the art will further recognize that the tower sections may be placed adjacent to each other, or apart from each other, dependent upon operator preferences and configuration limitations. Adjacent tower sections may be secured to each other to provide increased support.

Figure 5A:
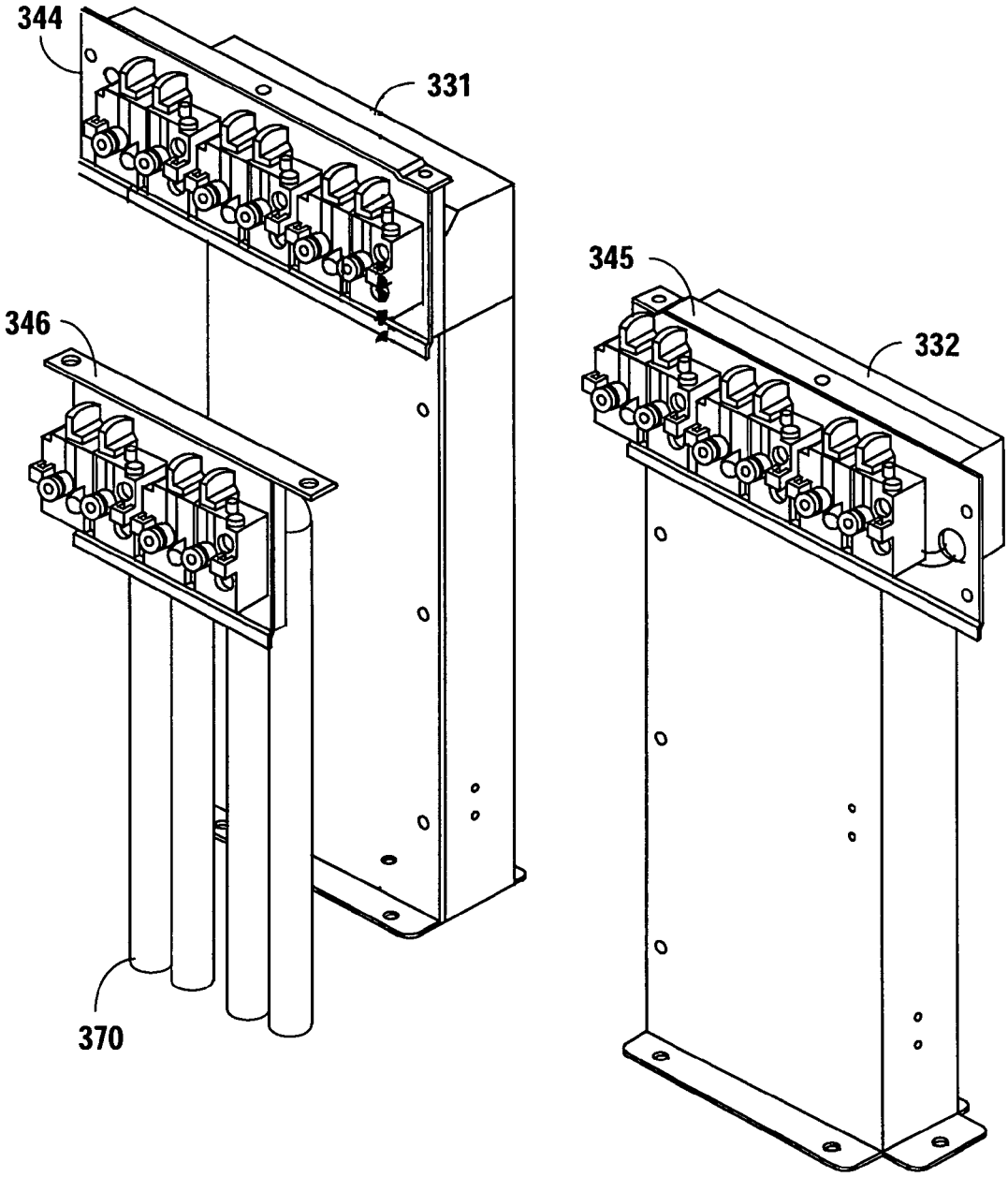
FIG. 5*a* provides a perspective view of tower sections according to a second embodiment.
Figure 5B:
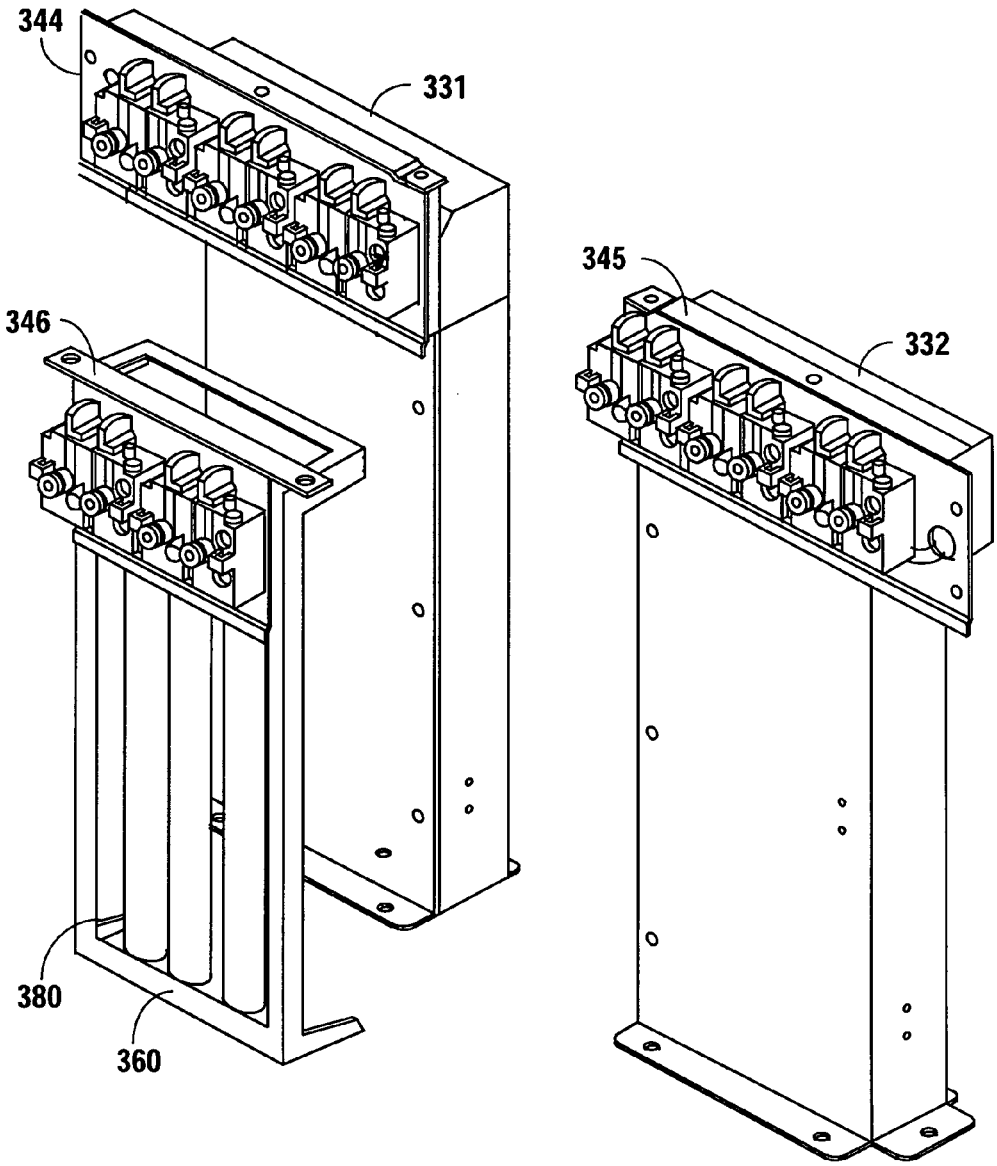
FIG. 5*b* provides a perspective view of tower sections according to an extension of the second embodiment.

As shown in FIG. 5*a*, a second embodiment of this invention utilizes a tower section 331 and a tower section 332 identical to the tower sections 131 and 132 of the first embodiment, thereby providing the ability to insert a tower section, or portions thereof, later. In this second embodiment, a mounting member 346 is disposed and secured in similar fashion to the first embodiment between the mounting members 344 and 345, such that flexible product lines 370 may be coupled to dispense points 102 and extend downward to the third array 212 of the housing 111. One of ordinary skill in the art will recognize that the flexible product lines 370 may include hardware suitable for adapting to the outlets of the third array 212, as well as the dispense points 102 disposed on the mounting member 346. The use of flexible product lines 370 provides the ability to reconfigure the product valves to dispense alternative products. One of ordinary skill in the art will further recognize that product lines not being utilized must be capped with a suitable pressure cap to prevent the spraying of product and fluids in the event the unused line is inadvertently pressurized.

In an extension of the second embodiment of this invention, the product dispenser 100 utilizes a tower section 331 and a tower section 332 identical to the second embodiment, thereby providing the ability to insert a tower section, or portions thereof, later. In this extension of the second embodiment, a support frame 360 including a mounting member 346 is disposed and secured in similar fashion to the second between the towers 331 and 332, such that the product lines 380 may be coupled to dispense points 102 and extend downward to the third array 212 of the housing 111. One of ordinary skill in the art will recognize that the product lines 380 may include hardware suitable for adapting to the outlets of the third array 212, as well as the dispense points 102 disposed on the mounting member 346. The product lines 380 may be constructed from flexible materials or may be rigid. One of ordinary skill in the art will further recognize that product lines not being utilized must be capped with a suitable pressure cap to prevent the spraying of product and fluids in the event the unused line is inadvertently pressurized.

Figure 6:
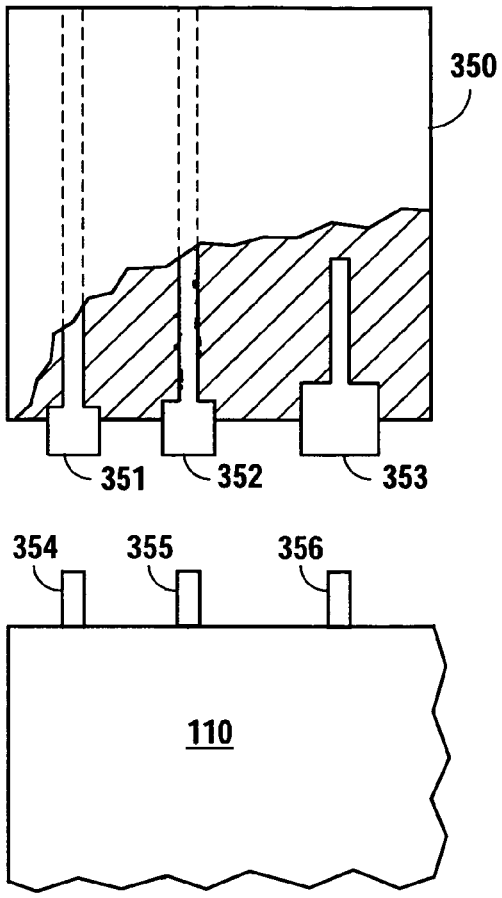
FIG. 6 provides a section view of a tower section including a capped line according to an alternative embodiment.

One of ordinary skill in the art will recognize that use of all product circuits is not required, and therefore, tower sections that do not utilize all outlets disposed in a mating array are possible. In such cases, the unused outlets of the housing product lines must be capped to prevent undesired spraying in the event the lines are inadvertently pressurized. Illustratively, the tower section would include a capped line. As shown in FIG. 6, a tower section 350 includes product lines 351 and 352 that deliver fluids to the dispense points 102 disposed on the tower section 350, and a capped product line 353 that does not deliver fluids to the dispense points 102, but does hold pressure. On assembly, the housing product lines 354-356 mate with the tower product lines 351-353, respectively, thereby capping any inadvertent flow through the housing product line 356. While this alternative embodiment has been shown with a single capped line, one of ordinary skill in the art will recognize that multiple capped lines may be utilized, up to and including a full tower section.

While the arrays 210-212 have been shown with similar shapes, one of ordinary skill in the art will recognize that the arrays 210-212 may be different from each other to prevent inadvertent swapping of the tower sections. One of ordinary skill in the art will further recognize that it is possible to deliver at least one concentrate line, at least one carbonated diluent line, and at least one plain diluent line to a particular array, thereby providing the ability to deliver any combination of product to a tower for delivery through the product valves 114.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A dispenser, comprising:

a housing including a first housing product circuit and a second housing product circuit;

a first tower section securable to the housing, the first tower section including a first tower product circuit having at least one inlet fluidly connected with the first housing product circuit and at least one outlet extending from the first tower section;

a second tower section securable to the housing, the second tower section including a second tower product circuit having at least one inlet fluidly connected with the second housing product circuit and at least one outlet extending from the second tower section;

a first mounting member secured at a forward face of the first tower section, wherein the first mounting member engages and aligns the at least one outlet from the first tower product circuit;

a second mounting member secured at a forward face of the second tower section, wherein the second mounting member engages and aligns the at least one outlet from the second tower product circuit;

a first dispense point mounted on the first mounting member and fluidly connected with the at least one outlet from first tower product circuit;

a second dispense point mounted on the second mounting member and fluidly connected with the at least one outlet from second tower product circuit; and the first mounting member and the second mounting member connect to form an integral mounting member that secures the first tower section with the second tower section, thereby providing alignment of the first dispense point with the second dispense point.

2. The dispenser according to claim 1, wherein the first tower product circuit is capped to cease the delivery of product to the first dispense point.

3. The dispenser according to claim 2, wherein the second tower product circuit is capped to cease the delivery of product to the second dispense point.

4. The dispenser according to claim 1, further comprising:

a third housing product circuit;

a third tower section securable to the housing, the third tower section including a third tower product circuit having at least one inlet fluidly connected with the third housing product circuit and at least one outlet extending from the third tower section;

a third mounting member secured with the third tower section, wherein the third mounting member engages and aligns the at least one outlet from the third tower product circuit;

a third dispense point mounted on the third mounting member and fluidly connected with the at least one outlet from third tower product circuit; and the second mounting member and the third mounting member connect to form an integral mounting member that secures the second tower section with the third tower section, thereby providing alignment of the first, second, and third dispense points.

5. The dispenser according to claim 1, wherein the first and second tower sections are replaceable at a dispensing location.

6. The dispenser according to claim 5, wherein a tower section is replaced by a tower section having more dispense points.

7. The dispenser according to claim 5, wherein a tower section is replaced by a tower section having fewer dispense points.

8. The dispenser according to claim 1, further comprising:

a third housing product circuit;

a third mounting member securable to one of or both of the first and second mounting members; and flexible tubing extending from a dispense point mounted on the third mounting member to the third housing product circuit.

9. The dispenser according to claim 1, wherein the first and second housing product circuits are identical, thereby allowing the first and second towers to be interchangeable.

10. The dispenser according to claim 1, wherein the first and second housing product circuits are different, thereby forcing a location specific tower.

11. The dispenser according to claim 1, wherein the first and second tower sections are disposed on non-adjacent housing product circuits.

12. The dispenser according to claim 1, further comprising:

a third housing product circuit;

a support frame disposed between the first and second tower sections, wherein at least one additional dispense point is are disposed on the support frame; and a product circuit disposed within the support frame, wherein the product circuit is coupled to the third housing product circuit.

13. The dispenser according to claim 12, further comprising:

a third mounting member disposed on the support frame to secure the at least one dispense points in alignment with the first and second dispense points, wherein the third mounting member is securable to and aligns with the first and second mounting members.

14. The dispenser according to claim 12, wherein the product circuit comprises flexible fluid delivery lines, thereby providing the ability to reconfigure the fluid delivery lines disposed within the support frame.

15. The dispenser according to claim 12, wherein the product circuit comprises hard plumbed fluid delivery lines.

16. The dispenser according to claim 1, wherein the first and second housing product circuits each comprise a plurality of product lines.

17. The dispenser according to claim 16, wherein the first tower product circuit comprises a plurality of product lines fluidly connected at an inlet with one of the plurality of product lines of the first housing product circuit.

18. The dispenser according to claim 17, wherein the first mounting member engages and spatially aligns each outlet of the plurality of product lines for the first product circuit extending from the first tower section.

19. The dispenser according to claim 18, further comprising a plurality of dispense points mounted on the first mounting member and fluidly connected with respective outlets of the plurality of product lines for the first product circuit.

20. The dispenser according to claim 19, wherein at least one of the plurality of product lines for the first product circuit is capped to cease the delivery of product to at least one of the plurality of dispense points.

21. The dispenser according to claim 19, wherein all of the plurality of product lines for the first product circuit are capped to cease the delivery of product to all of the plurality of dispense points.

22. The dispenser according to claim 16, wherein the second tower product circuit comprises a plurality of product lines fluidly connected at an inlet with one of the plurality of product lines of the second housing product circuit.

23. The dispenser according to claim 22, wherein the second mounting member engages and spatially aligns each outlet of the plurality of product lines for the second product circuit extending from the second tower section.

24. The dispenser according to claim 23, further comprising a plurality of dispense points mounted on the second mounting member and fluidly connected with respective outlets of the plurality of product lines for the second product circuit.

25. The dispenser according to claim 24, wherein at least one of the plurality of product lines for the second product circuit is capped to cease the delivery of product to at least one of the plurality of dispense points.

26. The dispenser according to claim 24, wherein all of the plurality of product lines for the second product circuit are capped to cease the delivery of product to all of the plurality of dispense points.

* * * * *